United States Patent [19]

Graven

[11] Patent Number: 4,610,778

[45] Date of Patent: Sep. 9, 1986

[54] TWO-STAGE HYDROCARBON DEWAXING PROCESS

[75] Inventor: Richard G. Graven, Pennington, N.J.

[73] Assignee: Mobil Oil Corporation, New York, N.Y.

[21] Appl. No.: 741,023

[22] Filed: Jun. 3, 1985

Related U.S. Application Data

[63] Continuation of Ser. No. 481,504, Apr. 1, 1983, abandoned.

[51] Int. Cl.[4] ..... C10G 47/16

[52] U.S. Cl. ..... 208/89; 208/97

[58] Field of Search ..... 208/86, 89, 97, 108, 208/216 R, 59, 111, 57, 123, 124, 112

[56] References Cited

U.S. PATENT DOCUMENTS

| | | | |
|---|---|---|---|
| 3,271,302 | 9/1966 | Gleim | 208/210 |
| 3,528,910 | 9/1970 | Haney et al. | 208/216 R |
| 3,736,252 | 5/1973 | Hayes | 208/89 X |
| 3,853,749 | 12/1974 | Espenscheid et al. | 208/307 |
| 3,894,938 | 7/1975 | Gorring et al. | 208/97 |
| 3,904,513 | 9/1975 | Fischer et al. | 208/264 |
| 3,915,894 | 10/1970 | Clements et al. | 208/216 R X |
| 3,948,763 | 4/1976 | Christman et al. | 208/216 R |
| 3,989,617 | 11/1976 | Yan | 208/87 |
| 4,057,488 | 11/1977 | Montagna et al. | 208/89 |
| 4,059,648 | 11/1977 | Derr et al. | 260/676 |
| 4,080,397 | 3/1978 | Derr et al. | 260/676 |
| 4,098,683 | 7/1978 | Conway | 208/97 X |
| 4,134,825 | 1/1979 | Bearden, Jr. et al. | 208/108 |
| 4,137,148 | 1/1979 | Gillespie et al. | 208/87 |
| 4,283,271 | 8/1981 | Garwood et al. | 208/59 |
| 4,283,272 | 8/1981 | Garwood et al. | 208/59 |
| 4,400,265 | 8/1983 | Shen | 208/97 |
| 4,414,097 | 11/1983 | Chester et al. | 208/59 |

*Primary Examiner*—Andrew H. Metz
*Assistant Examiner*—Glenn A. Caldarola
*Attorney, Agent, or Firm*—Alexander J. McKillop; Michael G. Gilman; Malcolm D. Keen

[57] ABSTRACT

The oxidation and thermal stability of severely hydrotreated lube stocks processed through a catalytic dewaxing process comprising a catalytic dewaxing step and a hydrofinishing step is improved by adding a relatively small amount of a sulfur compound upstream of the hydrofinishing step.

15 Claims, No Drawings

TWO-STAGE HYDROCARBON DEWAXING PROCESS

This application is a continuation of U.S. patent application Ser. No. 481,504, filed Apr. 1, 1983 and now abandoned.

BACKGROUND OF THE INVENTION

1. Field of the Invention

This invention is concerned with the manufacture of high-quality lubricating oils, and in particular is concerned with the catalytic dewaxing and hydrotreating of waxy distillate lubricating oils.

2. Discussion of Prior Art

The refining of petroleum crude oils to obtain lubricant stocks is based primarily on a series of steps including distillation, solvent refining and dewaxing.

For the preparation of a high grade distillate lubricating oil stock, the usual practice is to vacuum distill an atmospheric tower residuum from an appropriate crude oil as the first step. This step provides one or more raw stocks within the boiling range of about 450° to 1050° F. After preparation of a raw stock of suitable boiling range, it is extracted with a solvent, e.g, furfural, phenol, sulfolane, n-methylpyrrollidone or chlorex, which is selective for aromatic hydrocarbons, and which removes undesirable components. The raffinate from solvent refining is then dewaxed, for example, by admixing it with a solvent, such as a blend of methyl ethyl ketone and toluene. The mixture is chilled to induce crystallization of the paraffin waxes which are then separated from the raffinate. Sufficient quantities of wax are removed to provide the desired pour point for the raffinate.

Other processes, such as hydrofinishing or clay percolation, may be used if needed to reduce the nitrogen and sulfur content or improve the color of the lubricating oil stock.

Viscosity Index (V.I.) is a quality parameter of considerable importance for distillate lubricating oils used in automotive engines and aircraft engines which are subject to wide variations in temperature. This index indicates the degree of change of viscosity with temperature. For example, a high viscosity index, e.g., 100 or greater, indicates an oil that does not tend to become viscous at low temperatures or become thin at high temperatures. Measurement of the Saybolt Universal Viscosity of an oil at 100° and 210° F., and referral to standard industry-wide correlations, provides a measure of the V.I. of the oil. For purposes of the present invention, whenever V.I. is referred to, it designates the V.I. as noted in the Viscosity Index tabulations of the ASTM (D567), published by ASTM, 1916 Race Street, Philadelphia, PA, or equivalent thereof.

To prepare high V.I. automotive and aircraft oils the refiner usually selects a crude oil relatively rich in paraffinic hydrocarbons, since experience has shown that crudes poor in paraffins, such as those commonly termed "naphthene-base" crudes, yield little or no refined stock having a V.I. above about 40. Suitable stocks for high V.I. oils, however, also contain substantial quantities of waxes which result in solvent-refined lubricating oil stocks of high pour point. Thus, in general, the refining of crude oil to prepare acceptable high V.I. distillate stocks ordinarily includes dewaxing to reduce the pour point.

In recent years catalytic techniques have become available for dewaxing petroleum stocks. Although some attention has been directed to treating gas oils and manufacturing specialty oils, of primary interest has been and is the catalytic dewaxing and subsequent treatment of lube oil stocks. Processes relating to the dewaxing of gas oils and specialty oils are described in U.S. Pat. Nos. 3,894,938 and 4,137,148, the contents of both of which are incorporated herein by reference.

U.S. Pat. No. 3,894,938 discloses a catalytic dewaxing process in which high-pour-point, high-sulfur gas oils having a boiling range of about 400° F. to 900° F. are first contacted, in the presence or absence of added hydrogen, with a ZSM-5 type zeolite hydrodewaxing catalyst which may contain a hydrogenation/dehydrogenation component. The effluent therefrom is subsequently desulfurized and denitrogenated by contacting it with a cobalt-molybdenum-alumina catalyst.

U.S. Pat. No. 4,137,148 discloses a process wherein specialty oils of low pour point and excellent stability are produced from waxy crude distillates having a boiling range of 450° F. to 1050° F. by solvent refining, catalytic dewaxing over a zeolite catalyst, such as ZSM-5, and hydrotreating (hydrofinishing). The catalytic dewaxing reaction produces olefins which would impair properties of the dewaxed oil product if they were retained in the product. The olefins are saturated by hydrogenation in the hydrotreater, as confined by chemical analysis of the hydrotreated product for bromine number. Low bromine numbers are an indication of a satisfactory level of saturation. The hydrotreating step comprises cascading the effluent from the catalytic dewaxing step into a hydrotreating reactor of the type now generally employed for the finishing of lubricating oil stocks. Many of the known hydrotreating catalysts consisting of a hydrogenation component on a non-acidic support can be employed, for example, cobalt-molybdate or nickel-molybdate or molybdenum oxide, on an alumina support. Subsequent to this treatment, the effluent of the hydrotreater is topped by distillation to meet flash and firepoint specifications.

Techniques for dewaxing and subsequent treating of lubricating oil stocks are exemplified in U.S. Pat. Nos. 3,755,138 and 4,222,855, the contents of which are incorporated herein by reference.

U.S. Pat. No. 3,755,138 discloses a process wherein a lube oil stock boiling between 650° F. and 1100° F. is subjected to mild solvent dewaxing and subsequently to hydrodewaxing. The hydrodewaxing step constitutes contacting the lube oil stock with a crystalline aluminosilicate of the ZSM-5 type which contains a metal hydrogenating component in the presence of added hydrogen. In U.S. Pat. No. 4,222,855 lube oil stocks boiling between 600° F. and 1050° F. are catalytically dewaxed by contacting them with a crystalline aluminosilicate having particularly characterized pore openings, such as ZSM-23 and ZSM-35.

U.S. Pat. No. 3,668,113, the entire contents of which are incorporated herein by reference, discloses a process in which petroleum fractions, such as gas oil and wax distillate fractions, are first passed over a catalyst comprising a crystalline mordenite of reduced alkali metal content and a metal hydrogenating component to remove wax. The reaction product is then passed over a catalyst comprising a refractory inorganic oxide support and a hydrogenating component selected from metals and compounds thereof of Groups VI and VIII of the Periodic Table to remove sulfur.

U.S. Pat. No., Re. 28,398, the entire contents of which are incorporated herein by reference, discloses a catalytic process for dewaxing of oils by converting straight-chain and slightly branched-chain hydrocarbons by contacting the oils with a crystalline zeolite having specified molecular sieving properties, e.g., ZSM-5 type and ZSM-8 type zeolites, optionally containing a hydrogenation/dehydrogenation component.

It has also been proposed to combine, in series, severe lube hydrotreating (LHDT) and catalytic lube dewaxing processes (LDW) in order to improve resistance of products to light, e.g., see Garwood et al., U.S. Pat. No. 4,283,271 and Garwood et al., U.S. Pat. No. 4,283,272. However, the effluent of the LHDT process is essentially free from sulfur, which may adversely affect processing thereof after the LDW process.

SUMMARY OF THE INVENTION

This invention comprises the process of reducing the pour point of a hydrocarbon charge stock boiling in the range of about 400° F. to about 1050° F., and particularly a lubricating oil charge stock boiling between about 600° F. and about 1050° F. by subjecting this charge to the conditions of the catalytic tube hydrotreating process (also known as severe lube hydrotreating process or severe hydrotreatment process) and, subsequently, passing the effluent of that process to the catalytic dewaxing process. In the catalytic dewaxing process, the hydrocarbon charge is first passed through a catalytic reactor containing a ZSM-5 type catalyst to remove waxy components therefrom. The effluent of the catalytic reactor is then cascaded through a hydrofinishing step, conducted in the presence of a catalyst comprising a hydrogenation component on a non-acidic support, e.g., cobalt-molybdenum or nickel-molybdenum on alumina. A small amount of sulfur is added upstream of the hydrofinishing step. The process is applicable to treating any charge stocks containing petroleum wax, such as gas oil fractions boiling between about 400° F. and about 1050° F., lube oil stocks and deasphalted vacuum residues.

DETAILED DESCRIPTION OF THE INVENTION

As indicated previously, this invention is concerned with a process comprising severe lube hydrotreating followed by catalytic dewaxing which results in the production of a lubricating oil having an enhanced V.I. at a given pour point. It should be recognized that there are certain values of pour point which lubricating oils must possess to be commercially useful. Although there is a certain amount of flexibility concerning pour point specifications, nevertheless, target pour points for products differ depending on whether heavy or light neutral stock or bright stock is being produced. In general, it is desirable that the pour point of a heavy neutral stock be no higher than about 20° F., and the pour point of a light neutral stock be no higher than about 5° F. The term "heavy neutral stock" includes a product having the following properties:

| | Charge | Product |
|---|---|---|
| API Gravity | 29.2 | 27.8 |
| Pour Point, °F. | 105 | 20 |
| Viscosity, centipoise (cs) | | |
| Kv at 100° F. | 81.9 | 108.4 |
| Kv at 210° F. | 9.95 | 10.99 |
| Boiling Range (Initial Boiling Point, IBP-95%), °F. | 632–970 | 669–983 |

The term "light neutral stock" includes a product having the following properties:

| | Charge | Product |
|---|---|---|
| API Gravity | 32.1 | 29.6 |
| Pour Point, °F. | 95 | 5 |
| Viscosity, CS | | |
| Kv at 100° F. | — | 37.84 |
| Kv at 130° F. | 14.28 | — |
| Kv at 210° F. | 4.47 | 5.64 |
| Boiling Range (IBP-95%), °F. | 687–847 | 716–844 |

The charge stock used in the process of the invention includes petroleum oils boiling between about 600° F. and about 1050° F. as well as other processed oils. The boiling points referred to above are boiling points at atmospheric pressure, and they may be determined by vacuum assay in the manner known to those skilled in the art.

In the severe lube hydrotreating process, a hydrotreater, containing a fixed bed of a conversion catalyst comprising mixed sulfides of Groups VIA and VIIIA metals, e.g., nickel, molybdenum, tungsten, on an alumina or silica/alumina support, optionally containing an acid promoter, processes waxy distillates, deasphalted vacuum resids and similar feeds to product high viscosity index (HVI) base oils. The severe lube hydrotreating process operates under hydrogen pressure (at typical hydrogen partial pressures of about 100 to 250 bar) to catalytically transfer undesirable hydrocarbons into highly desirable hydrocarbons. The chemical reactions promoted in the LHDT process include hydrogenation of polyaromatics into polynaphthenes, hydrodecyclization of polyaromatics and polynaphthenoaromatics into mononaphthenes and hydroisomerization of normal paraffins into isoparaffins. The products of these reactions contribute to high viscosity index and high pour point of the product. The LHDT process is usually conducted at the pressure of 150–250 bars, temperature of 720°–790° F. (380°–420° C.), at an overall space velocity of 0.3–1, and at hydrogen recycle ratio of about 800 to about 1200 vol/vol. Additional details of the LHDT process are disclosed in the literature, e.g., Billion et al., *Consider Hydrorefining For Lubes,* Hydrocarbon Processing, September 1975, pages 139–143, and Bull et al., *Lube Oil Manufacture by Severe Hydrotreatment,* a paper published in the proceedings of the 10th World Petroleum Congress, Bucharest, Hungary, Volume 4, Storage, Transport and Processing, published by Heyden and Son, Ltd., affiliated with Spectrum House, London, England (1980), pages 221–228, the entire contents of both of which are incorporated herein by reference.

The effluent of the severe lube hydrotreating process is then conducted to a catalytic lube dewaxing process comprising two steps. In the first step, the effluent is contacted with a ZSM-5 type catalyst, e.g., ZSM-5, ZSM-11, ZSM-12, ZSM-22, ZSM-23, ZSM-35, ZSM-38 and ZSM-48 zeolite. ZSM-5 is described in U.S. Pat. Nos. 3,702,886 and RE 29,948; ZSM-11 is described in U.S. Pat. No. 3,709,979; ZSM-12 is described in U.S.

Pat. No. 3,832,449; ZSM-22 is described in a pending U.S. patent application Ser. No. 373,451, filed Apr. 30, 1982; ZSM-23 is described in U.S. Pat. No. 4,076,842; ZSM-35 is described in U.S. Pat. No. 4,016,245; ZSM-38 is described in U.S. Pat. No. 4,046,859; ZSM-48 is described in a pending allowed U.S. patent application Ser. No. 303,276, filed Sept. 17, 1981. The entire contents of all of the aforementioned patent applications and patents are incorporated herein by reference. The product of this catalytic dewaxing step is then conducted to a hydrofinishing step of the catalytic lube dewaxing process, wherein it is contacted with a hydrofinishing catalyst. The hydrofinishing catalyst comprises a hydrogenation component of a non-acidic support, such as alumina or silica/alumina. Suitable catalysts comprise at least one metal, metal oxide or metal sulfide of Group VIA or VIIIA of the Periodic Chart of the Elements, published by Fisher Scientific Company, Catalog Number 5-702-10 (1978), such as molybdenum (Mo), cobalt-molybdenum (CoMo), nickel-molybdenum (NiMo) or NiCoMo. A small amount of a sulfur compound is added to the process upstream of the hydrofinishing reactor, e.g., to the feedstock of the catalytic dewaxing process, to the catalytic reactor containing the ZSM-5 type zeolite or to the effluent of that reactor. The amount of the added sulfur compound is such that it provides about 20 to about 250 ppm by weight of sulfur in the hydrofinishing reactor, based on feed in the hydrofinishing reactor. A suitable sulfur compound is hydrogen sulfide or any sulfur compound which, under hydrogenating conditions in the presence of a metal catalyst, will decompose to form hydrogen sulfide ($H_2S$), e.g., dimethyl sulfide, carbon disulfide, methyl mercaptan, amyl mercaptan or butyl mercaptan.

The addition of sulfur compound is necessary because the hydrocarbon feedstock, introduced into the catalytic lube dewaxing process from the LHDT process, is relatively low in sulfur, e.g., 30 to 50 parts per million (ppm). This relatively low sulfur, it is believed, if not rectified, would result in oxidative and thermal instability of the product of the catalytic lube dewaxing process. In some instances, it may be desirable to partially dewax the solvent-refined stock by conventional dewaxing techniques prior to severe lube hydrotreating. The higher melting point waxes so removed are those of greater hardness and higher market value than the waxes removed in taking the product to a still lower pour point.

In gas oil dewaxing, the catalytic dewaxing step is operated at a temperature of about 300°–1000° F., a pressure of 0–2000 psig, and an LHSV of 0.1 to 10 with a hydrogen to hydrocarbon mole ratio of about 0 to 25:1. This catalytic dewaxing phase of the overall operation is described in U.S. Pat. No. 3,894,938, the entire contents of which are incorporated herein by reference.

In lube stock dewaxing, operating conditions for the catalytic hydrodewaxing step include a temperature between about 500 and about 675° F., a pressure between about 100 and about 4000 psig, and preferably between about 200 and about 3500 psig. The liquid hourly space velocity is generally between about 0.1 and about 10, and preferably between about 0.5 and about 4, and the hydrogen to feedstock ratio is generally between about 400 and about 8000, and preferably between about 800 and 5000 standard cubic feet (scf) of hydrogen per barrel of feed.

The catalytic dewaxing step of this invention may be conducted by contacting the feed to be dewaxed with a fixed stationary bed of catalyst, or with a transport bed, as desired. A preferred configuration is a trickle-bed operation, in which the feed is allowed to trickle through a stationary fixed bed, preferably in the presence of hydrogen. The dewaxing operation usually is initiated at a temperature of about 500° F. This temperature is, of course, raised as the catalyst ages in order to maintain catalytic activity. In general, the run is terminated at an end-of-run temperature of about 700° F., at which time the catalyst may be reactivated by contact at elevated temperature with hydrogen gas, or regenerated by contact with oxygen-containing gas. Catalysts which can be used include those of the ZSM-5 type, as set forth above. The catalyst, particularly if it is of the ZSM-5 type, may have incorporated therein a hydrogen transfer functional component, such as nickel, palladium, or platinum in a proportion of 0.05 to 5 weight percent, based on the total weight of the catalyst.

The product of the catalytic dewaxing step can be fractionated into liquid and gas portions by cooling to a prescribed temperature at an appropriate pressure. The liquid can then be subjected to the hydrofinishing step. It is preferred, however, to subject the entire dewaxed product to the hydrofinishing step. In general, hydrofinishing conditions include a temperature of 425° to 850° F., preferably 475° to 700° F.; a space velocity (LHSV) of 0.1 to 4.0 volumes of charge oil per volume of catalyst per hour, preferably 0.5 to 2 LHSV; a pressure of 100–4000 psig, preferably 500–3500 psig with 500 to 10,000 standard cubic feet of hydrogen per barrel of feed (scf/bbl), preferably 1500 to 5000 scf/bbl. It is preferred to conduct the hydrofinishing step by contacting the dewaxed product with the hydrofinishing catalyst (e.g., Mo, CoMo, NiMo or CoNiMo on alumina support) in a fixed stationary bed.

It will be apparent to those skilled in the art that the specific embodiments discussed above can be successfully repeated with ingredients equivalent to those generically or specifically set forth above and under variable process conditions.

From the foregoing specification, one skilled in the art can readily ascertain the essential features of this invention and without departing from the spirit and scope thereof can adapt it to various diverse applications.

I claim:

1. A process for catalytically dewaxing and hydrotreating a waxy hydrocarbon fraction to provide a lubricating oil of high viscosity index which comprises passing a sulfur containing fraction through a severe lube hydrotreating process step to produce an effluent which is relatively low in sulfur, adding a sulfur compound and contacting the effluent and said sulfur compound with a dewaxing catalyst under conditions sufficient to effect at least a partial dewaxing of the effluent and contacting the reaction product thereby obtained in a hydrofinishing reactor in the presence of said added sulfur compound with hydrogen and a hydrofinishing catalyst comprising at least one Group VIA or VIIIA metal, metal oxide or metal sulfide, said sulfur compound being added in an amount so as to provide about 20 to about 250 ppm by weight of sulfur in the hydrofinishing reactor based on the weight of the feed in the hydrofinishing reactor.

2. A process of claim 1 wherein said sulfur compound is hydrogen sulfide, dimethyl sulfide, carbon disulfide, methyl mercaptan, amyl mercaptan or butyl mercaptan.

3. A process of claim 2 wherein the waxy hydrocarbon fraction is a gas oil fraction boiling between about 400° F. and about 1050° F. or a deasphalted residuum.

4. A process of claim 3 wherein said sulfur compound is added to the effluent.

5. A process of claim 3 wherein said sulfur compound is added to the catalytic reactor containing said dewaxing catalyst.

6. A process of claim 4 wherein said dewaxing catalyst is ZSM-5.

7. A process of claim 5 wherein said dewaxing catalyst is ZSM-5.

8. A process of claim 6 wherein said hydrofinishing catalyst comprises Mo, NiMo, CoMo or NiCoMo.

9. A process of claim 7 wherein said hydrofinishing catalyst comprises Mo, NiMo, CoMo or NiCoMo.

10. A process of claim 8 wherein said contacting with said hydrofinishing catalyst is conducted at temperature of 425° F. to 850° F., space velocity of 0.1 to 4.0 LHSV, pressure of 100 to 4000 psig and at 500 to 10,000 standard cubic feet of hydrogen per barrel of feed.

11. A process of claim 9 wherein said contacting with said hydrofinishing catalyst is conducted at temperature of 425° F. to 850° F., space velocity of 0.1 to 4.0 LHSV, pressure of 100 to 4000 psig and at 500 to 10,000 standard cubic feet of hydrogen per barrel of feed.

12. A process for refining a sulfur containing crude oil relatively rich in paraffins to produce a lubricating oil of high viscosity index, including providing a sulfur containing fraction boiling in the range of from about 400° to about 1050° F., passing said sulfur containing fraction through a severe lube hydrotreating process step to produce an effluent which is relatively low in sulfur, adding a sulfur compound to the effluent, contacting the effluent of the severe lube hydrotreating process step containing the added sulfur compound with a dewaxing catalyst selected from the group consisting of ZSM-5, ZSM-11, ZSM-12, ZSM-22, ZSM-23, ZSM-35, ZSM-38, and ZSM-48 under conditions sufficient to effect at least a partial dewaxing of the effluent and, contacting the reaction product thereby obtained in a hydrofinishing reactor in the presence of said sulfur compound with hydrogen and a hydrofinishing catalyst comprising at least one Group VIA or VIIIA metal, metal oxide or metal sulfide, said sulfur compound being added in an amount so as to provide about 20 to about 250 ppm by weight of sulfur in the hydrofinishing reactor based on the weight of feed in the hydrofinishing reactor.

13. The process of claim 12 wherein said hydrofinishing catalyst is a Group VIA metal oxide or metal sulfide.

14. A process of claim 12, wherein the fraction is a gas oil fraction boiling between about 600° and about 1050° F. or a deasphalted residuum.

15. A process of claim 14, wherein said fraction is partially dewaxed by solvent dewaxing techniques prior to the severe lube hydrotreating process step.

* * * * *